US009016851B2

(12) United States Patent
Murakami

(10) Patent No.: US 9,016,851 B2
(45) Date of Patent: Apr. 28, 2015

(54) RECORDING APPARATUS

(71) Applicant: Kenji Murakami, Nagoya (JP)

(72) Inventor: Kenji Murakami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/040,546

(22) Filed: Sep. 27, 2013

(65) Prior Publication Data

US 2014/0184713 A1 Jul. 3, 2014

(30) Foreign Application Priority Data

Dec. 28, 2012 (JP) ..... 2012-287309

(51) Int. Cl.
*B41J 2/01* (2006.01)
*B41J 11/00* (2006.01)
*B41J 11/08* (2006.01)

(52) U.S. Cl.
CPC ..... *B41J 11/005* (2013.01); *B41J 11/08* (2013.01)

(58) Field of Classification Search
CPC ..... B41J 11/007; B41J 11/06; B41J 11/085; B41J 13/103; B41J 11/0065
USPC ..... 347/104, 101
See application file for complete search history.

(56) References Cited

U.S. PATENT DOCUMENTS

| | | | | |
|---|---|---|---|---|
| 5,648,837 | A * | 7/1997 | Tamai | 355/72 |
| 2005/0201765 | A1 * | 9/2005 | Shinga | 399/16 |
| 2008/0049058 | A1 * | 2/2008 | Yakura et al. | 347/14 |
| 2014/0210905 | A1 | 7/2014 | Murakami | |

FOREIGN PATENT DOCUMENTS

| | | | | |
|---|---|---|---|---|
| JP | 2010-155445 | A | 7/2010 | |
| JP | 2010-208241 | * | 9/2010 | B41J 11/14 |
| JP | 2010-208241 | A | 9/2010 | |
| JP | 2014-148055 | A | 8/2014 | |

OTHER PUBLICATIONS

United States Patent and Trademark Office, Office Action for U.S. Appl. No. 14/168,194 (related to above-captioned patent application), mailed Sep. 18, 2014.

* cited by examiner

*Primary Examiner* — Manish S Shah
*Assistant Examiner* — Yaovi Ameh
(74) *Attorney, Agent, or Firm* — Baker Botts L.L.P.

(57) ABSTRACT

A first guide includes a guiding face to support a recording medium on an upstream of a head in a conveyance direction, a recess formed on the upstream of the head in the conveyance direction, and a protrusion to protrude from the guiding face through the recess. The protrusion includes a first slope upwardly inclined from an upstream end of the protrusion toward the downstream. Atop of the protrusion is positioned on the same level as or an upper level than an upstream end of a supporter, when the supporter is at an opposing position and the protrusion protrudes from the guiding face.

13 Claims, 9 Drawing Sheets

RECORDING APPARATUS

CROSS REFERENCE TO RELATED APPLICATION

This application claims priority from Japanese Patent Application No. 2012-287309, which was filed on Dec. 28, 2012, the disclosure of which is herein incorporated by reference in its entirety.

BACKGROUND OF THE INVENTION

1. Field of the Invention

The present invention relates to a recording apparatus configured to record an image by ejecting liquid onto a recording medium.

2. Description of Related Art

A known recording apparatus includes a supporter and a mover configured to move the supporter so as to cause the supporter to take either an opposing position at which the supporter opposes an ejection surface of a head or a withdrawal position at which the supporter does not oppose the ejection surface. The supporter is, for example, positioned at the opposing position in recording and positioned at the withdrawal position in a maintenance operation. The supporter may include an upstream supporter and a downstream supporter both of which are positioned on an upper surface of a frame.

SUMMARY OF THE INVENTION

The upstream end of the upper surface of the frame may constitute a guiding face which is configured to support a recording medium on the upstream of the head in the conveyance direction. If a level difference including a vertical gap is formed between the guiding face and the upstream end of the upstream supporter, the leading end of the recording medium is caught at the difference, and this may cause the jamming of the recording medium.

An object of the present invention is to provide a recording apparatus in which the occurrence of the jamming of a recording medium is restrained.

A recording apparatus according to a first aspect of the invention comprises a head, a conveyor, a supporter, a mover and a first guide. The head includes an ejection surface on which a plurality of ejection openings for ejecting liquid are formed. The conveyor is configured to convey a recording medium toward a space which opposes the ejection surface. The supporter is configured to support a recording medium in the space. The mover is configured to move the supporter in a conveyance direction in which the recording medium is conveyed by the conveyor to cause the supporter to take either an opposing position at which the supporter opposes the ejection surface or a withdrawal position at which the supporter does not oppose the ejection surface. The first guide includes a guiding face which is configured to support the recording: medium on the upstream of the head in the conveyance direction, a recess which is formed on the upstream of the head in the conveyance direction, and a protrusion which is configured to protrude from the guiding face through the recess. The protrusion includes a first slope upwardly inclined from an upstream end of the protrusion in the conveyance direction toward the downstream in the conveyance direction.

A recording apparatus according to a second aspect of the invention comprises a head, a conveyor, a supporter, a mover and a first guide. The head includes an ejection surface on which a plurality of ejection openings for ejecting liquid are formed. The conveyor is configured to convey a recording medium toward a space which opposes the ejection surface. The supporter is configured to support the recording medium in the space. The mover is configured to move the supporter in a conveyance direction in which the recording medium is conveyed by the conveyor to cause the supporter to take either an opposing position at which the supporter opposes the ejection surface or a withdrawal position at which the supporter does not oppose the ejection surface. The first guide includes a guiding face which is configured to support the recording medium on the upstream of the head in the conveyance direction and a protrusion which is positioned on the upstream of the head in the conveyance direction, is integrated with the guiding face, and is configured to protrude from the guiding face. The protrusion includes a first slope upwardly inclined from an upstream end of the protrusion in the conveyance direction toward the downstream in the conveyance direction.

A recording apparatus according to a third aspect of the invention comprises a head, a conveyor, a supporter, a mover and a guide. The head includes an ejection surface on which a plurality of ejection openings for ejecting liquid are formed. The conveyor is configured to convey a recording medium toward a space which opposes the ejection surface. The supporter is configured to support the recording medium in the space. The mover is configured to move the supporter in a conveyance direction in which the recording medium is conveyed by the conveyor to cause the supporter to take either an opposing position at which the supporter opposes the ejection surface or a withdrawal position at which the supporter does not oppose the ejection surface. The guide includes a guiding face which is configured to support the recording medium on the upstream of the head in the conveyance direction, and a protrusion which is positioned on the upstream of the head in the conveyance direction and is configured to protrude from the guiding face. The protrusion includes an upstream end and a first slope. The upstream end of the protrusion in the conveyance direction is positioned on the same level as or a lower level than the guiding face. The first slope is upwardly inclined from the upstream end of the protrusion toward the downstream in the conveyance direction.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following will describe a preferred embodiment of the present invention with reference to figures. In the following description, the expressions "front", "rear", "upper", "lower", "right", and "left" are used to define the various parts when a recording apparatus of the present invention is disposed in an orientation in which it is intended to be used.

To begin with, referring to FIG. 1, the overall structure of an inkjet printer 1 of First Embodiment of the present invention will be described.

The printer 1 includes a rectangular parallelepiped housing 1*a*. On the top plate of the housing 1*a* is provided a sheet discharge section 4. The internal space of the housing 1*a* is divided into a space A which is the upper space and a space B which is the lower space. In the spaces A and B, a conveying path of sheets P is formed to extend from a sheet feeding section 23 toward the sheet discharge section 4. The sheets P are conveyed along the black thick arrows shown in FIG. 1. In the space A, image formation on each sheet P and the conveyance of the sheets P to the sheet discharge section 4 are conducted. In the space B, the sheets P are conveyed from the sheet feeding section 23 to the conveying path.

Figure 5:
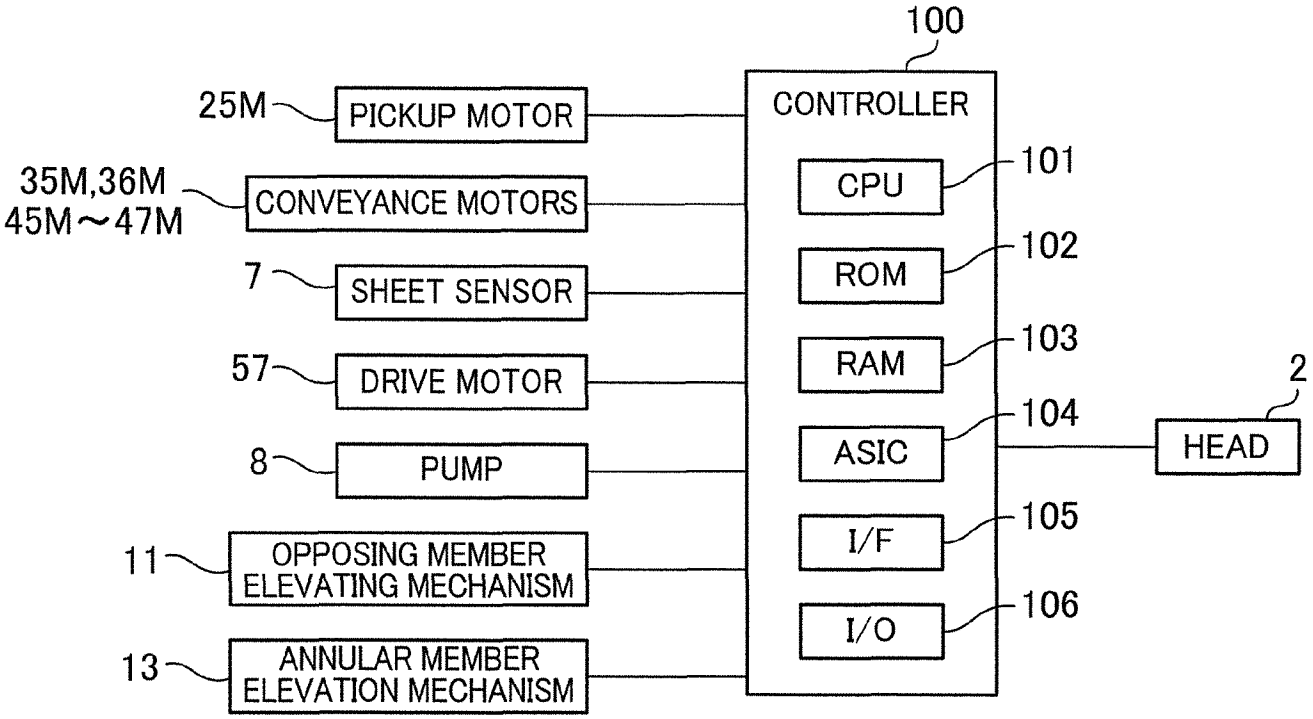
FIG. 5 is a block diagram showing the electric configuration of the printer.

In the space A, members such as a head 2, a conveyor 3, an opposing member 10, and an opposing member elevating mechanism 11 are provided (see FIG. 5). To the space A, a cartridge (not illustrated) is attached. This cartridge stores black ink. The cartridge is connected to the head 2 via a tube (not illustrated) and a pump 8 (see FIG. 5). The ink in the cartridge is supplied to the head 2.

The head 2 is a line-type head. The head 2 is rectangular parallelepiped in shape and long in the main scanning direction. The lower surface of the head 2 functions as an ejection surface 2*a* on which a plurality of ejection openings (not illustrated) are formed. When recording is carried out, the black ink is ejected through the ejection openings. The head 2 is supported by the housing 1*a* via a holder 2*b*. The holder 2*b* holds the head 2 so that a predetermined gap suitable for the recording is formed between the platen 51 and the ejection surface 2*a*.

The conveyor 3 includes an upstream guide unit 30, a downstream guide unit 40, and a supporter 50. Hereinafter, the upstream and the downstream in a conveyance direction D in which the sheets P are conveyed by a roller pair 36 will be simply referred to as "upstream" and "downstream", respectively. The supporter 50 includes a platen 51. Between the platen 51 and the ejection surface 2*a* is formed a recording space. This recording space opposes the ejection surface 2*a* and constitutes a conveying path.

The guide units 30 and 40 are positioned to sandwich the platen 51. The upstream guide unit 30 includes four guides 31 to 34 and two roller pairs 35 and 36 and connects the recording space with the sheet feeding section 23. The two roller pairs 35 and 36 are rotated by conveyance motors 35M and 36M (see FIG. 5) under the control of a controller 100 so as to convey the sheets P toward the recording space.

The downstream guide unit 40 includes three guides 41 to 43 and three roller pairs 45 to 47 and connects the recording space with the sheet discharge section 4. The three roller pairs 45 to 47 are rotated, by conveyance motors 45M to 47M (see FIG. 5) under the control of the controller 100 so as to convey the sheets P toward the sheet discharge section 4. The conveying path is defined by the seven guides 31 to 34 and 41 to 13, the platen 51, and the head 2.

Figure 1:
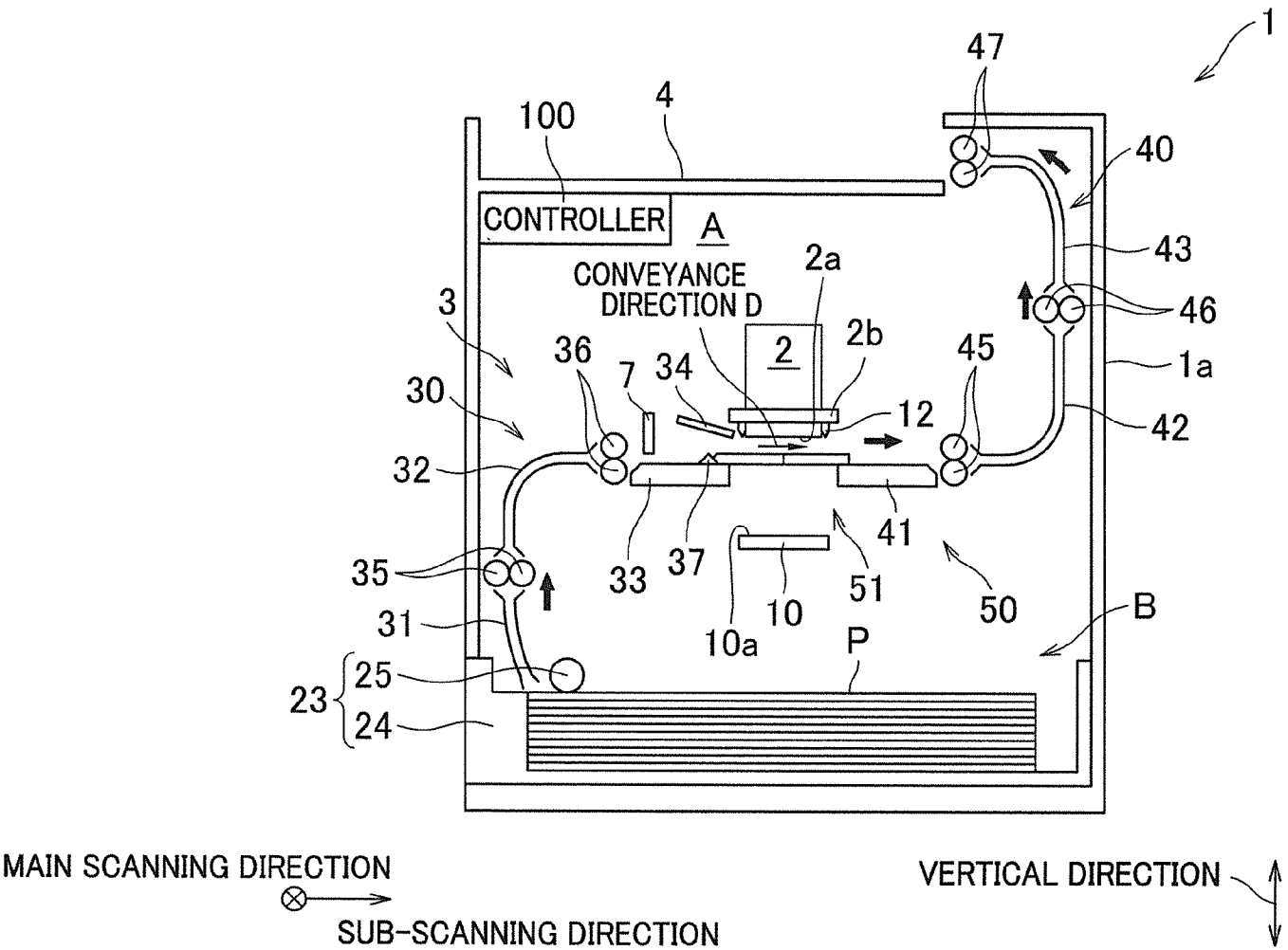
FIG. 1 is a schematic profile showing the internal structure of an inkjet printer of First Embodiment of the present invention.

As shown in FIG. 1, the opposing member 10 is positioned below the platen 51 and opposes the ejection surface 2*a* over the platen 51. The opposing member 10 is formed by a rectangular glass plate and is a size larger than the ejection surface 2*a* when viewed in the vertical direction (see FIG. 4). The opposing member 10 may be made of any material other than glass.

Figure 6A:
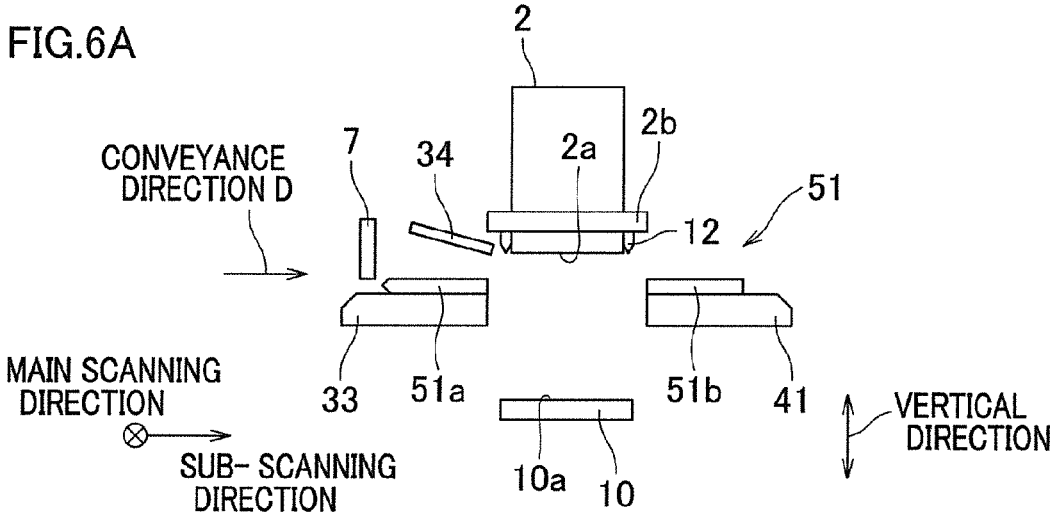
FIG. 6A is a partial profile of the printer when the platen is at the withdrawal position and an opposing member is at a waiting position.
Figure 6B:
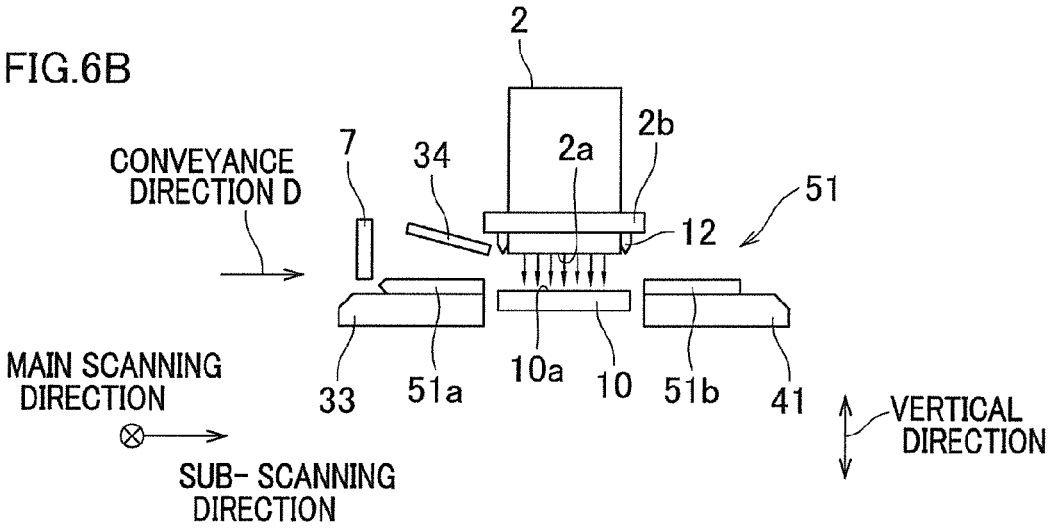
FIG. 6B is a partial profile of the printer when the platen is at the withdrawal position and the opposing member is at an ink receiving position.
Figure 6C:
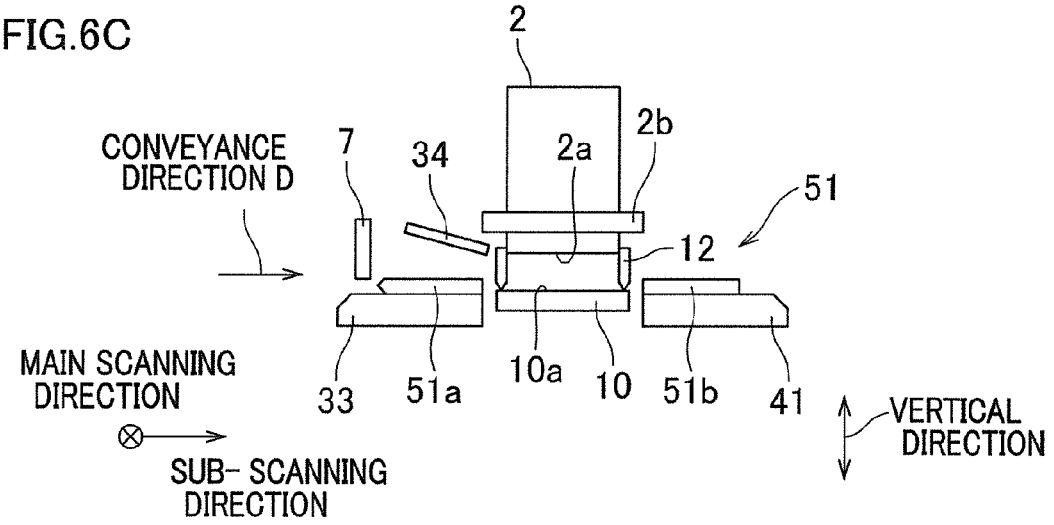
FIG. 6C is a partial profile of the printer when the platen is at the withdrawal position and an annular member is in contact with the opposing member which is at the ink receiving position.

The opposing member elevating mechanism 11 is configured to vertically move the opposing member 10. The opposing member 10 therefore takes a waiting position or an ink receiving position. The waiting position which is shown in FIG. 1 and FIG. 6A is a position where the opposing member 10 is most distant from the ejection surface 2*a*. The ink receiving position which is shown in FIG. 6B is a position where the opposing member 10 is closest to the ejection surface 2*a*. When the opposing member 10 is at the ink receiving position, the opposing member 10 receives the ink ejected from the ejection openings. The opposing member 10 corresponds to the receiver of the present invention. The opposing member 10 is also at the ink receiving position when the surface 10*a* of the opposing member 10 is wiped and when the capping is conducted. An annular member 12 is positioned to entirely surround the periphery of the ejection surface 2*a*. An annular member elevation mechanism 13 is configured to vertically move the annular member 12. The annular member 12 therefore takes a position (shown in FIG. 6C) where the annular member 12 contacts with the opposing member 10 at the ink receiving position or a position (shown in FIG. 6A) where the annular member 12 does not contact with the opposing member 10. The opposing member 10, the opposing member elevating mechanism 11, the annular member 12, and the annular member elevation mechanism 13 constitute a maintenance unit of the present invention. The maintenance unit is configured to conduct a maintenance operation to recover and maintain the capability of the ink ejection from the ejection openings.

In the space B is provided a sheet feeding section 23. This sheet feeding section 23 includes a sheet feeding tray 24 and a pickup roller 25. The sheet feeding tray 24 is configured to be detachable to the housing 1*a*. The sheet feeding tray 24 is an open-top box capable of storing the sheets P. The pickup roller 25 is rotated by a pickup motor 25M (see FIG. 5) under the control of the controller 100, and sends out the topmost sheet P in the sheet feeding tray 24.

The sub-scanning direction is in parallel to the conveyance direction D. The main scanning direction is in parallel to the horizontal plane and orthogonal to the sub-scanning direction. The vertical direction is orthogonal to the main scanning direction, the sub-scanning direction, and the ejection surface 2*a*. The vertical direction corresponds to the orthogonal direction in the present invention.

The controller 100 manages the overall operation of the printer 1 by controlling the operation of each part of the printer 1. The controller 100 controls the recording operation based on a recording command input from an external apparatus (e.g., a PC connected to the printer 1). More specifically, upon receiving the recording command, the controller 100 drives the pickup roller 25 and the roller pairs 35, 36, and 45 to 47. A sheet P sent out from the sheet feeding tray 24 is guided by the upstream guide unit 30 to the surface of the platen 51. When the sheet P passes through the position immediately below the head 2 in the conveyance direction D, ink is ejected from the ejection openings under the control of the controller 100, with the result that a desired image is formed on the sheet P. The timing to eject the ink from the ejection openings is determined based on a detection signal sent from the sheet sensor 7. The sheet P on which the image has been formed is guided by the downstream guide unit 40 and discharged to the sheet discharge section 4 from an upper part of the housing 1*a*. The sheet sensor 7 is positioned between the roller pair 36 and the head 2 in the conveyance direction D.

The controller 100 controls the maintenance operation. The maintenance operation includes purging, wiping, and capping. The purging is an operation to forcibly discharge ink to the opposing member 10 from all ejection openings by means of the pressure supplied to the ejection openings from the pump 8. The wiping is an operation conducted for the ejection surface 2*a* and the surface 10*a* after the purging, to remove foreign matters (such as ink) remaining on the surfaces. The capping is an operation to close the recording space and separate the recording space from the external space by causing the annular member 12 to contact with the opposing member 10 which is at the ink receiving position. The opposing member 10 and the annular member 12 constitute a cap of the present invention.

Figure 2A:
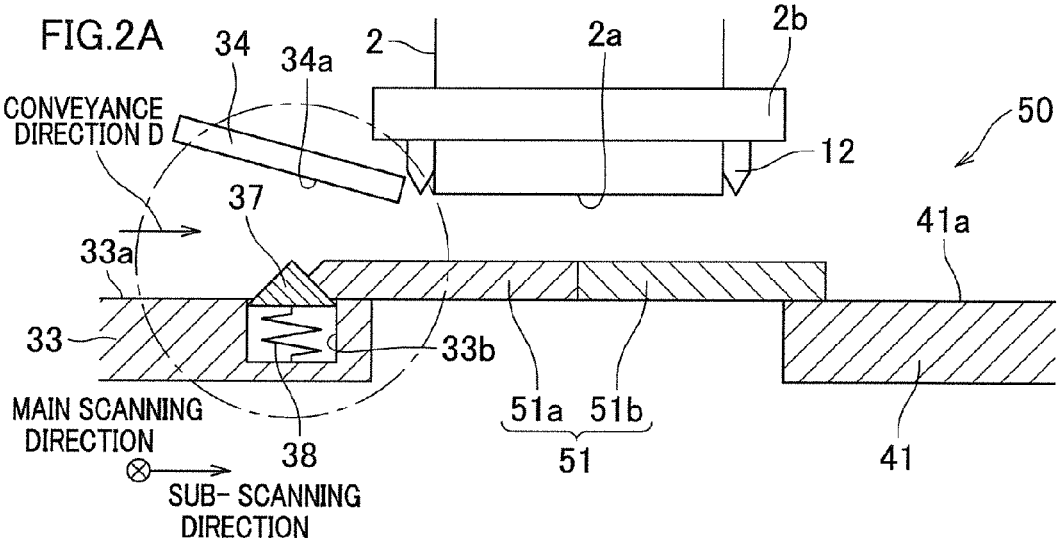
FIG. 2A is a partial profile of the printer when a platen is at an opposing position.
Figure 2B:
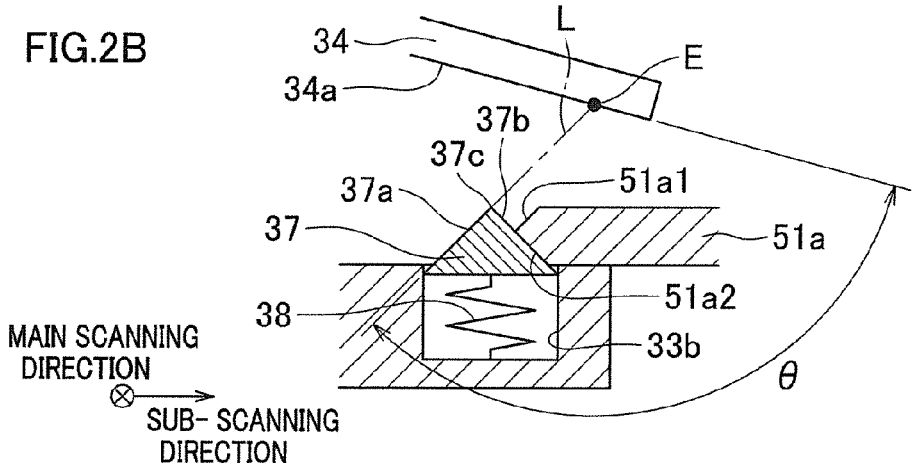
FIG. 2B is an enlarged view of the region encircled by the dashed line in FIG. 2A.

Now, referring to FIG. 2A, FIG. 2B, FIG. 2C, FIG. 3, and FIG. 4, the guides 33, 34, and 41 and the supporter 50 will be detailed. The guide 33 corresponds to the first guide of the present invention, and the guide 34 corresponds to the second guide of the present invention. As shown in FIG. 2A, FIG. 2B, FIG. 2C, and FIG. 3, the platen 51 includes an upstream supporter 51*a* and a downstream supporter 51*b*. The downstream supporter 51*b* is positioned on the downstream of the upstream supporter 51*a*. Each of these supporters 51*a* and 51*b* is a plate having a rectangular shape in plan view. As shown in FIG. 2B, the upstream supporter 51*a* has two slopes 51*a*1 and 51*a*2. The slope 51*a*1 is inclined upward (in the first direction in the present invention) from the upstream end of the upstream supporter 51*a* to the downstream. The slope 51*a*1 corresponds to the second slope of the present invention. The slope 51*a*2 is inclined downward (in the second direction in the present invention) from the upstream end of the upstream supporter 51*a* to the downstream.

Figure 3:
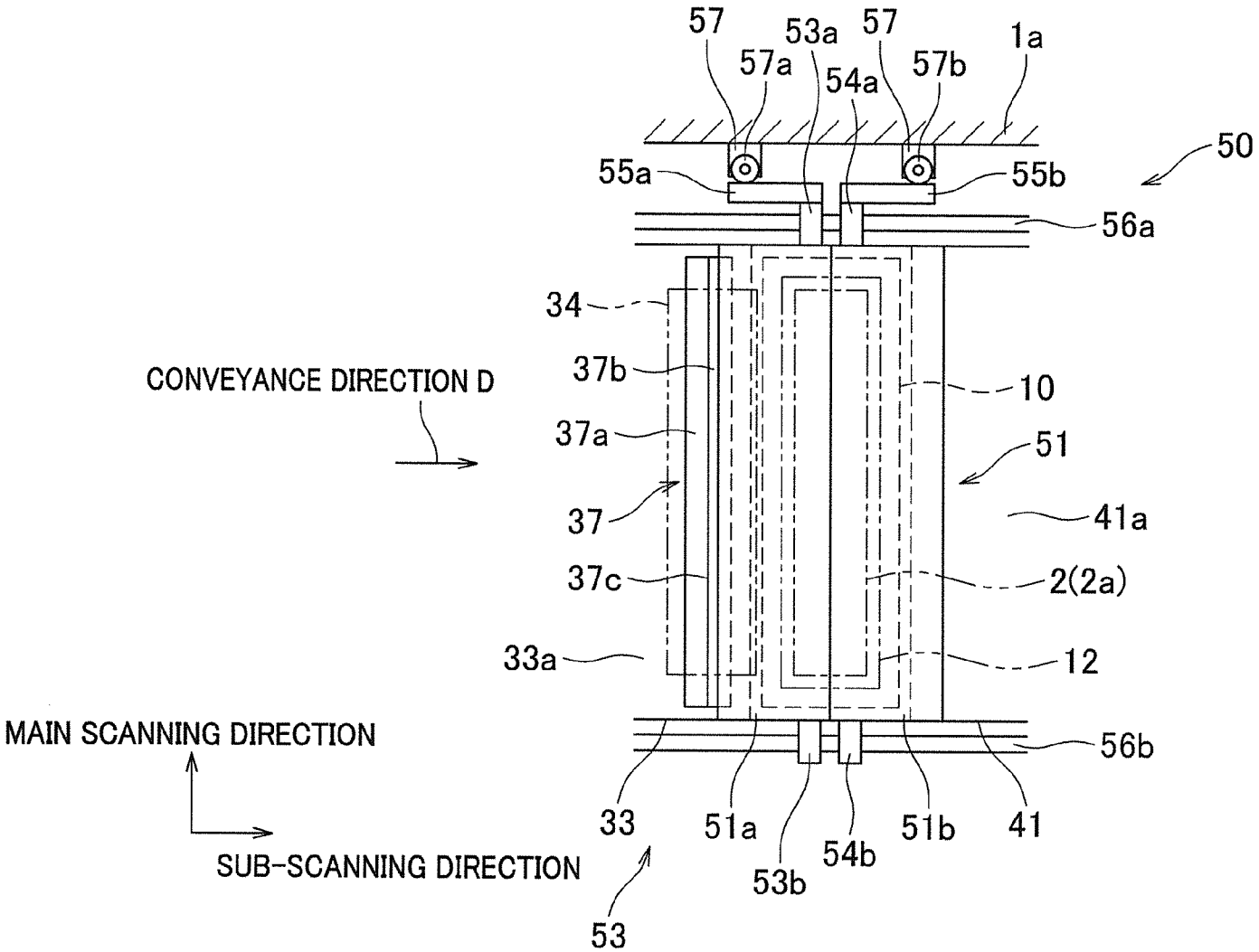
FIG. 3 is a plan view of the platen and a mover.

The supporter 50 is configured to be moved by a mover 53 shown in FIG. 3. The mover 53 includes two protrusions 53*a* and 53*b* protruding from the respective side surfaces of the upstream supporter 51*a*, two protrusions 54*a* and 54*b* protruding from the respective side surfaces of the downstream supporter 51*b*, two racks 55*a* and 55*b*, two guide shafts 56*a* and 56*b*, and two drive motors 57. The overall structure of the mover 53 is illustrated only in FIG. 3 for convenience of explanation.

At the center of each of the protrusions 53*a*, 53*b*, 54*a*, and 54*b*, a through hole is formed to extend in the conveyance direction D. The two guide shafts 56*a* and 56*b* extend in the conveyance direction D to sandwich the platen 51 in the main scanning direction. The guide shaft 56*a* is inserted into the through holes of the protrusions 53*a* and 54*a*. The guide shaft 56*b* is inserted into the through holes of the protrusions 53*b* and 54*b*. The guide shafts 56*a* and 56*b* support the supporters 51*a* and 51*b* to be movable in the conveyance direction D. To the leading end of the drive shaft of each drive motor 57, a pinion 57*a*, 57*b* is fixed. The rack 55*a* is fixed to the protrusion 53*a* while being engaged with the pinion 57*a*. The rack 55*b* is fixed to the protrusion 54*a* while being engaged with the pinion 57*b*.

As the two drive motors 57 are driven under the control of the controller 100, the two racks 55*a* and 55*b* are moved in opposite directions along the conveyance direction D. That is to say, the mover 53 moves the supporters 51*a* and 51*b* in opposite directions along the conveyance direction D so that the platen 51 takes either the opposing position where the platen 51 opposes the ejection surface 2*a* or the withdrawal position where the platen 51 does not oppose the ejection surface 2*a*. More specifically, when the platen 51 moves from the opposing position to the withdrawal position, the upstream supporter 51*a* moves toward the upstream whereas the downstream supporter 51*b* moves toward the downstream. When the platen 51 moves from the withdrawal position to the opposing position, the supporters move in the opposite directions.

When the platen 51 is at the opposing position, the opposing ends of the supporters 51*a* and 51*b* contact with each other (see FIG. 2A and FIG. 3). In this state, the upper surfaces of the supporters 51*a* and 51*b* form a smooth plane having no gaps in the conveyance direction D, and the sheet P is supported on this plane. The upper surfaces of the supporters 51*a* and 51*b* are both flat and on the same level as each other. When the platen 51 is at the withdrawal position, the opposing ends of the respective supporters 51*a* and 51*b* are positioned to overlap the guides 33 and 41 (see FIG. 2C). In this state, the ejection surface 2*a* does not oppose the platen 51 but directly opposes the opposing member 10 over the space. The opposing member 10 is vertically movable. The supporters 51*a* and 51*b* are normally at the opposing position, and are positioned at the withdrawal position when the maintenance operation is conducted.

As shown in FIG. 2A, FIG. 2B, FIG. 2C, FIG. 3, and FIG. 4, the guide 33 is a flat rectangular plate and is positioned on the upstream of the ejection surface 2*a* of the head 2. The guide 41 is a flat rectangular plate and is positioned on the downstream of the ejection surface 2*a* of the head 2. The upper surfaces of the guides 33 and 41 function as guiding faces 33*a* and 41 supporting the sheet P. The guiding faces 33*a* and 41*a* are both flat and on the same level as each other. The guiding faces 33*a* and 41*a* slidably contact with the lower surface of the platen 51. In other words, the platen 51 is positioned above the guiding faces 33*a* and 41*a*.

Figure 4:
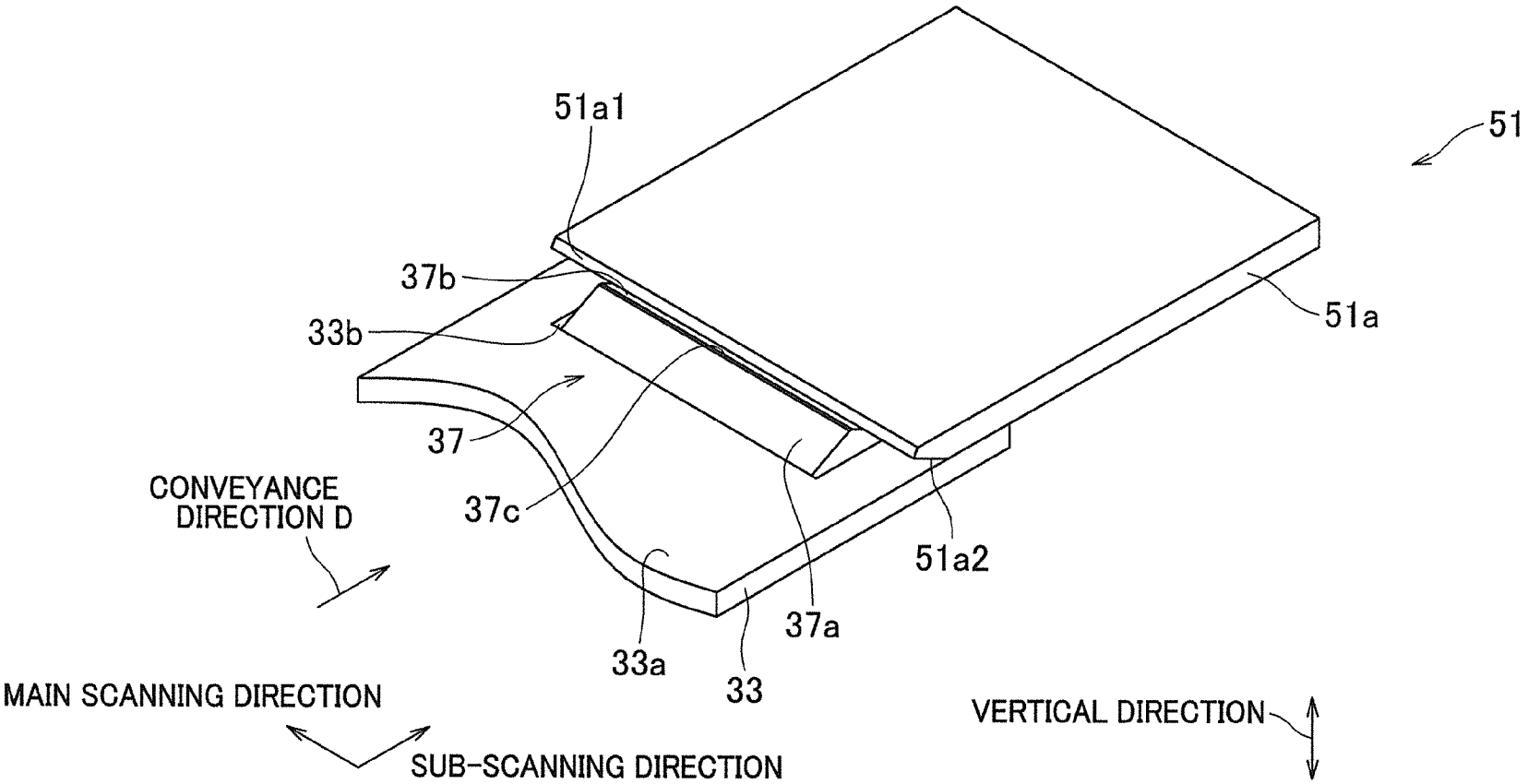
FIG. 4 is an oblique perspective view of a guide and an upstream supporter.

As shown in FIG. 2A, FIG. 2B, FIG. 2C, FIG. 3, and FIG. 4, the guide 33 has a protrusion 37. The protrusion 37 is configured to protrude upward from the guiding face 33*a*. As shown in FIG. 3 and FIG. 4, the protrusion 37 extends along the main scanning direction and is longer than the ejection surface 2*a* in the main scanning direction. As shown in FIG. 2B, the protrusion 37 is triangular in cross section and has two slopes 37*a* and 37*b*. The slope 37*a* extends from the upstream end of the protrusion 37 to the top 37*c* of the protrusion 37, and is inclined upward toward the downstream. The slope 37*b* extends from the top 37*c* to the downstream end of the protrusion 37 and is inclined downward toward the downstream. The slope 37*a* corresponds to the first slope of the present invention, and the slope 37*b* corresponds to the third slope of the present invention.

The guide 33 includes a recess 33*b* and an urger 38. The recess 33*b* is formed on the upstream of the ejection surface 2*a* of the head 2 and is concave in cross section. The urger 38 is positioned on the bottom surface of the guide 33, which surface defines the recess 33*b*. On the guiding face 33*a*, the opening of the recess 33*b* is formed. When viewed in the vertical direction, the opening is a size larger than the protrusion 37. The depth of the recess 33*b* is longer than the protruding length of the protrusion 37. The recess 33*b* is therefore able to house the protrusion 37 therein. The protrusion 37 is configured to be moved no as to take either a protruding position where the top 37*c* protrudes from the guiding face 33*a* or a housed position where the top 37*c* does not protrude from the guiding face 33*a*. The recess 33*b* is positioned in the vicinity of the downstream end of the guiding face 33*a* to at least partly overlap the upstream end of the upstream supporter 51*a* at the opposing position, in the conveyance direction D. At least the lower end of the protrusion 37 is positioned inside the recess 33*b*. The urger 38 is positioned between the lower surface of the protrusion 37 and the bottom surface of the guide 33 defining the recess 33*b*, to urge the protrusion 37 upward. The urger 38 urges the protrusion 37 from the housed position toward the protruding position. The urger 38 is, for example, constituted by a coil spring. The urger 38 may be constituted by any type of member on condition that the protrusion 37 is urged thereby in the direction described above.

Figure 2C:
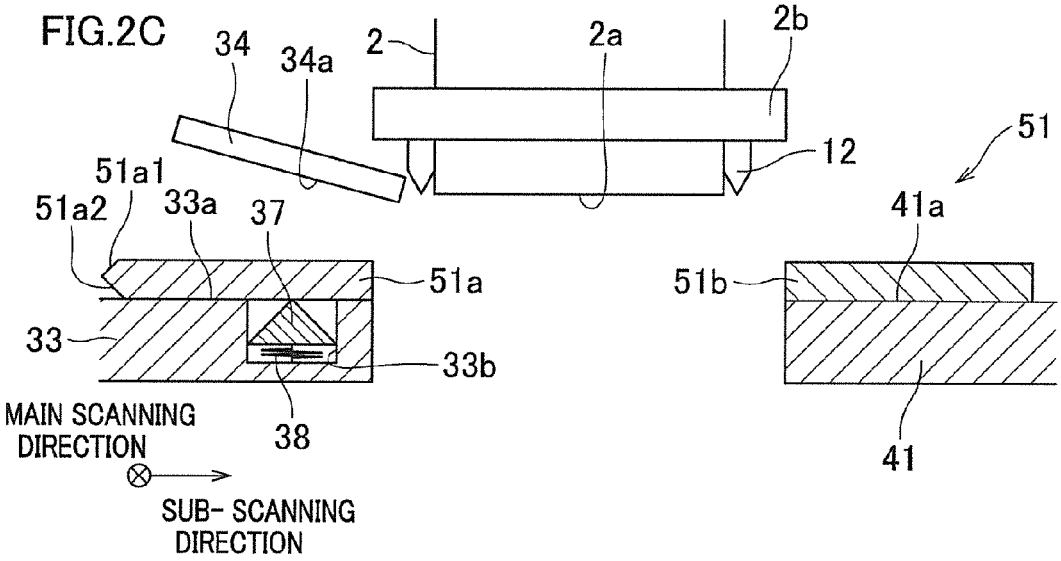
FIG. 2C is a partial profile of the printer when the platen is at a withdrawal position.

The acute angle formed by the slope 37*b* of the protrusion 37 and the horizontal plane is substantially identical with the acute angle formed by the slope 51*a*2 of the upstream supporter 51*a* and the horizontal plane. As shown in FIG. 2B, the slope 37*b* contacts with the slope 51*a*2 when the platen 51 is at the opposing position. As the protrusion 37 contacts with the upstream supporter 51*a* in this manner, the protrusion 37 is positioned at the protruding position and the degree of protrusion of the protrusion 37 from the guiding face 33*a* is regulated (see FIG. 2B). In this state, the top 37*c* is positioned on an upper level than the upstream end of the upstream supporter 51*a* and on the same level as the upper surface of the upstream supporter 51*a*. In this regard, the top 37*c* is required to be on the same level as or an upper level than the upstream end of the upstream supporter 51*a*, and on the same level as or an upper level than the upper surface of the upstream supporter 51*a*. In other words, the upper surface of the platen 51 is required to be on the same level as or a lower level than the top 37*c*. Furthermore, the upstream end of the protrusion 37 is on the same level as the lower surface of the protrusion 37 and on a lower level than the guiding face 33*a*. To put it differently, the upstream end of the protrusion 37 is housed in the recess 33*b*. In this regard, the upstream end of the protrusion 37 is required to be on the same level as or a lower level than the guiding face 33*a*. As the platen 51 is moved from the opposing position to the withdrawal position, i.e., the upstream supporter 51*a* is moved to the upstream, the protrusion 37 is moved downward while the slope 51*a*2 is being in contact with the slope 37*b*. In other words, as shown in FIG. 2C, the protrusion 37 is moved to the housed position below against the urging force of the urger 38, and is consequently housed in the recess 33*b*. When the protrusion 37 is at the housed position, the top 37*c* is in contact with the lower surface of the upstream supporter 51*a*.

As shown in FIG. 2A to FIG. 2C, the guide 34 is positioned on the upstream of the ejection surface 2*a* of the head 2 and includes an opposing surface 34*a* opposing the protrusion 37. The guide 34 corresponds to the second guide of the present invention. The guide 34 is constituted by a plate. As shown in FIG. 3, the guide 34 is substantially as long as the ejection surface 2*a* in the main scanning direction. As shown in FIG. 2B, the guide 34 is disposed so that a linear line L extending along the slope 37*a* and a linear line which extends along a part of the opposing surface 34*a* which part is on the downstream of an intersection E of the linear line L and the opposing surface 34*a* forms an obtuse angle θ. The downstream end of the opposing surface 34*a* is positioned on an upper level than the upper surface of the upstream supporter 51*a* and on a lower level than the ejection surface 2*a*. The downstream end of the opposing surface 34*a* may be on the same level as the ejection surface 2*a*.

Now, referring to FIG. 5, an electric configuration of the printer 1 will be described.

The controller 100 includes a CPU (Central Processing Unit) 101, a ROM (Read Only Memory) 102, a RAM (Random Access Memory including non-volatile RAM) 103, an ASIC (Application Specific Integrated Circuit) 104, an I/F (Interface) 105, and an I/O (Input/Output Port) 106. The ROM 102 stores programs conducted by the CPU 101, various types of fixed data, or the like. The RAM 103 temporarily stores data required for executing a program. The ASIC 104 conducts operations such as rewriting and reordering of image data (e.g., signal processing and image processing). The I/F 105 exchanges data with an external apparatus. The I/O 106 conducts input/output of detection signals to/from sensors.

The controller 100 is connected to the pickup motor 25M, the conveyance motors 35M, 36M, and 45M to 47M, the drive motor 57, the sheet sensor 7, the pump 8, the opposing member elevating mechanism 11, the annular member elevation mechanism 13, and the control substrate of the head 2.

Now, the recording operation will be described. Upon receiving a recording command, the controller 100 controls the parts so that the recording operation is conducted.

Before the conveyance of the sheet P starts, the controller 100 controls the mover 53 so as to move the platen 51 from the withdrawal position to the opposing position, when the platen 51 is at the withdrawal position. When the platen 51 is at the opposing position before the start of the conveyance of the sheet P, this control is not conducted. Thereafter, the controller 100 controls the motors so as to drive the pickup roller 25 and the roller pairs 35, 36, and 45 to 47. The sheet P sent out from the sheet feeding tray 24 is guided by the upstream guide unit 30 to the surface of the platen 51.

The sheet P is conveyed along the guiding face 33*a* while being sandwiched between the rollers of the roller pair 36. When the leading end of the sheet P reaches the protrusion 37, the leading end is lifted from the guiding face 33*a* by the slope 37*a*, and the sheet P is guided obliquely upward along the slope 37*a*. In this state, the protrusion 37 is at the protruding position. To put it differently, the top 37*c* protrudes from the guiding face 33*a* through the recess 33*b*. Because the upstream end of the protrusion 37 is on the same level as or a lower level than the guiding face 33*a*, the leading end of the sheet P is not caught at the protrusion 37. This is because there is no gap in the vertical direction between the guiding face 33*a* and the protrusion 37. Subsequently, the leading end of the sheet P gets over the top 37*c* and the sheet P is conveyed to the upper surface of the platen 51. In this regard, the top 37*c* is on the same level as or an upper level than the upstream end of the upstream supporter 51*a*. For this reason, the leading end of the sheet P is not caught by the upstream end of the upstream supporter 51*a*. Because the upstream supporter 51*a* has the slope 51*a*1, even if the leading end of the sheet P having got over the top 37*c* falls below the top 37*c*, the leading end of the sheet P is smoothly led to the upper surface of the platen 51 by the slope 51*a*1. This further restrains the occurrence of the jamming of the sheet P.

On the extension of the slope 37*a* is positioned the guide 34. This prevents the sheet P from colliding with the upstream side face of the head 2, even if the sheet P is conveyed at a relatively high conveyance speed and guided obliquely upward by the slope 37*a*. This also contributes to the suppression of the jamming of the sheet P.

When the sheet P passes through the position immediately below the head 2 in the conveyance direction D, the controller 100 controls the head 2 so that the ink is ejected through the ejection openings and a desired image is formed on the sheet P. Thereafter, the sheet P is guided by the downstream guide unit 40 and discharged to the sheet discharge section 4 from an upper part of the housing 1*a*.

Now, the maintenance operation will be described. Upon receiving a maintenance instruction (e.g., a purging signal or a capping signal), the controller 100 controls the parts so that the maintenance operation is conducted.

Upon receiving the purging signal, the controller 100 controls the mover 53 to move the platen 51 to the withdrawal position as shown in FIG. 6A. Thereafter, as shown in FIG. 6B, the controller 100 controls the opposing member elevating mechanism 11 to move the opposing member 10 from the waiting position to the ink receiving position. Subsequently, the controller 100 controls the pump 8 so as to discharge the ink through all ejection openings of the head 2. The discharged ink is received by the surface 10*a*. As the ink is received by the surface 10*a*, the housing 1*a* hardly becomes dirty inside.

Subsequently the controller 100 controls a wiping unit (not illustrated) to wipe the ejection surface 2*a* and the surface 10*a*. This makes it possible to remove the foreign matters remaining on the ejection surface 2*a* and the surface 10*a*. The removed foreign matters are sent to a foreign matter processor (not illustrated). Upon receiving the capping signal, the controller 100 controls the annular member elevation mechanism 13 so that the annular member 12 contacts with the surface 10*a* and the recording space is closed and separated from the external space. The capping is conducted in this way, and the drying of the ink in the ejection opening is restrained. As such, the maintenance operation is completed. Thereafter, upon receiving a recording command, the controller 100 controls the annular member elevation mechanism 13 to return the annular member 12 to the original position (which is shown in FIG. 6A and is a position at which the annular member 12 does not contact with the opposing member 10). Furthermore, the controller 100 controls the opposing member elevating mechanism 11 and the mover 53 so as to move the opposing member 10 to the waiting position and move the platen 51 to the opposing position. Then the recording operation starts.

As described above, in the printer 1 of the present embodiment, when the platen 51 is at the opposing position, the protrusion 37 is positioned on the upstream of the platen 51. Between the guiding face 33*a* and the protrusion 37, no gap is formed in the vertical direction. The leading end of the conveyed sheet P is therefore guided along the slope 37*a* to the surface of the platen 51. The occurrence of the jamming of the sheet P is therefore restrained.

When the platen 51 is at the opposing position, the upstream end of the upstream supporter 51*a* is positioned between the upstream end and the downstream end of the protrusion 37 in the conveyance direction D, and is in contact with the slope 37*b*. The leading end of the conveyed sheet P is therefore smoothly conveyed from the slope 37*a* to the surface of the platen 51. This further restrains the occurrence of the jamming of the sheet P.

The protrusion 37 is configured to be housed into the recess 33*b*. It is unnecessary to house the protrusion 37 in the upstream supporter 51*a* when the upstream supporter 51*a* is moved to the withdrawal position, with the result that the thickness of the upstream supporter 51*a* is reduced. This makes it possible to reduce the fluctuation of the sheet P with respect to the thickness direction of the sheet P during the conveyance.

When the platen 51 is moved from the opposing position to the withdrawal position, the protrusion 37 is housed in the recess 33*b* as the upstream supporter 51*a* contacts with the slope 37*b*. Therefore, the protrusion 37 is easily moved to the housed position only by moving the platen 51 from the opposing position to the withdrawal position.

The upper surface of the platen 51 is on the same level as or a lower level than the top 37*c*. This allows the leading end of the conveyed sheet P to be smoothly conveyed to the upper surface of the platen 51. This further restrains the occurrence of the jamming of the sheet P.

Figure 7:
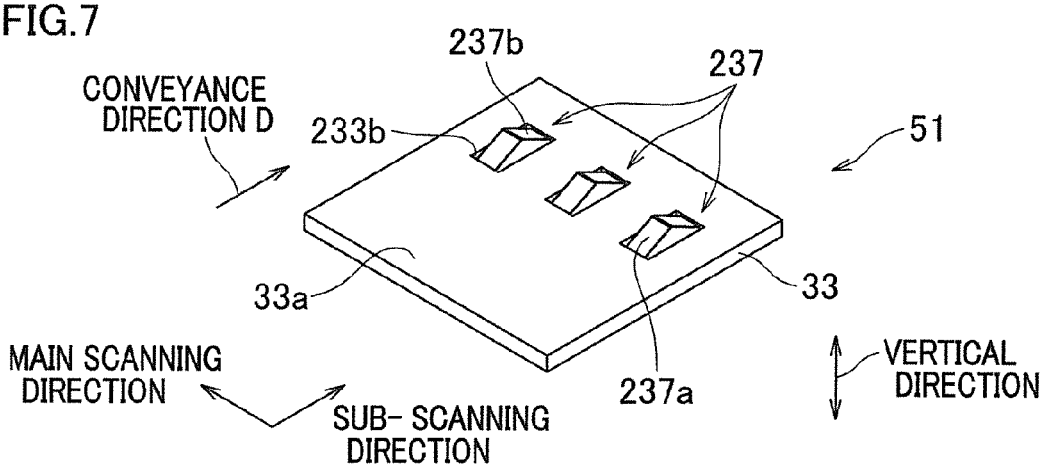
FIG. 7 is an oblique perspective view showing a first variation.
Figure 8:
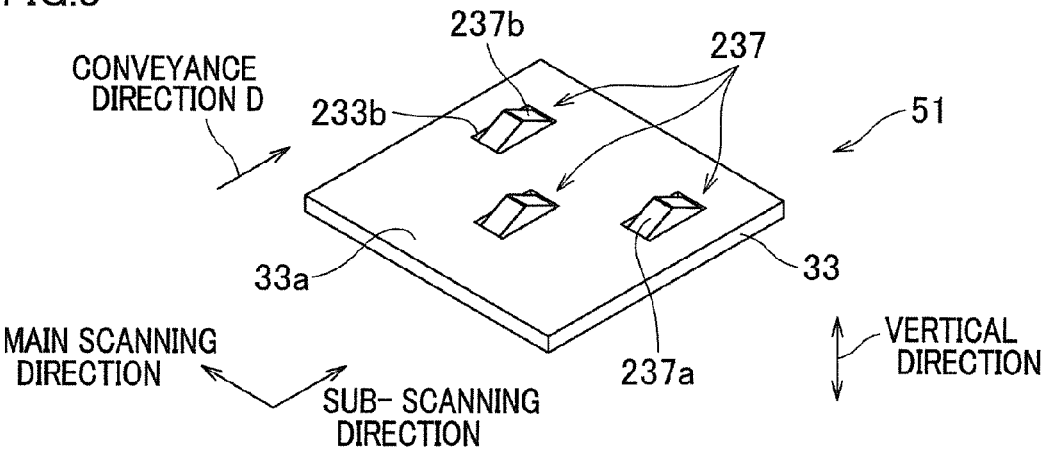
FIG. 8 is an oblique perspective view showing a second variation.

The protrusion 37 is long in the main scanning direction. The invention, however, is not limited to this configuration. For example, as a first variation shown in FIG. 7 indicates, three protrusions 237 may be lined up in the main scanning direction at equal intervals. According to the first variation, three recesses 233*b* each of which is a size larger than the protrusion 237 in plan view are formed in the guiding face 33*a*. In each recess 233*b*, an urger 38 is provided. With this configuration, each protrusion 237 is moved in the vertical direction to take either the protruding position or the housed position, in the same manner as the protrusion 37 of First Embodiment. Each protrusion 237 includes slopes 237*a* and 237*b* which are identical with the respective slopes 37*a* and 37*b*. According to the first variation, the leading end side of the conveyed sheet P partially contacts with the protrusions 237. Therefore, in the first variation, the conveyance load on the sheet P is low as compared to First Embodiment in which the entirety of the leading end side of the sheet P contacts with the protrusion 37. The conveyance load means a load applied to the sheet P in the conveyance of the sheet P. Alternatively, as a second variation shown in FIG. 8 indicates, a protrusion 237 which is positioned at the center in the main scanning direction among three protrusions 237 may be positioned on the upstream as compared to the other two protrusions 237. When the protrusions 237 are provided at different positions in the conveyance direction D, the leading end side of the sheet P contacts with the protrusions 237 at different timings, and the leading end side of the sheet P is guided along the slope 237*a*. This configuration makes it possible to reduce the conveyance load when the sheet P is guided along the slope 237*a*. Moreover, because the protrusion 237 positioned at the center in the main scanning direction is on the upstream of the other two protrusions 237, it is possible to effectively reduce the conveyance load when the sheet P is guided along the slope 237*a*.

Figure 9:
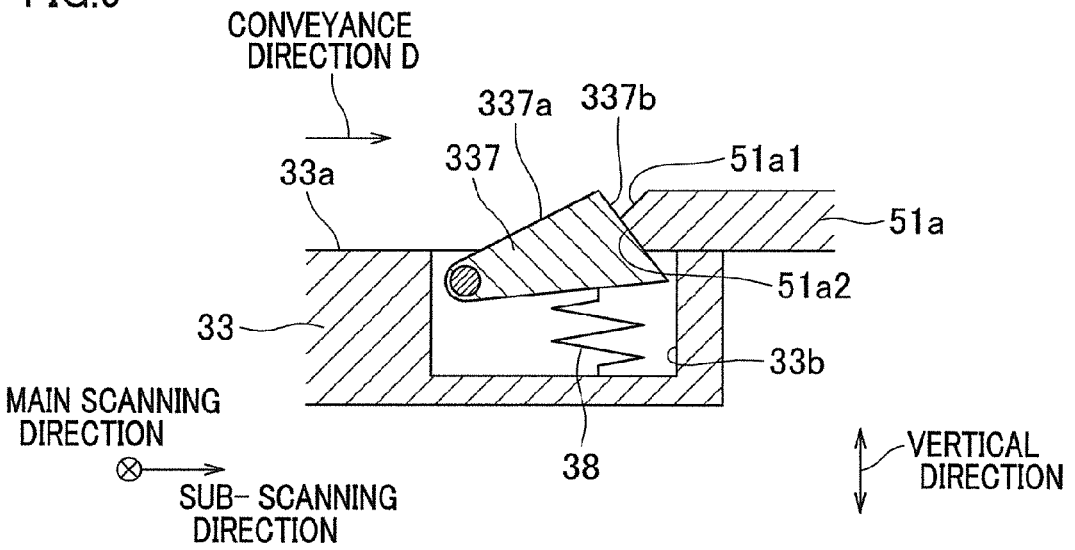
FIG. 9 is a partial cross section of a third variation.

As a third variation shown in FIG. 9 indicates, the protrusion 337 may be supported by the guide 33 so that the upstream end of the protrusion 337 is rotatable in the recess 33*b*. In this configuration, the protrusion 337 smoothly and stably rotates when the platen 51 is moved from the opposing position to the withdrawal position. The movement of the platen 51 is therefore not obstructed. The protrusion 337 has slopes 337*a* and 337*b* which are identical with the respective slopes 37*a* and 37*b*. The acute angle formed by the slope 337*a* and the guiding face 33*a* is smaller than the acute angle formed by the slope 337*b* and the guiding face 33*a*. The configuration makes it possible to achieve the downsizing and reduce the conveyance load when the conveyed sheet P contacts the slope 337*a*, as compared to a case where the angles are identical with each other. Also in First Embodiment, the acute angle formed by the slope 37*a* and the guiding face 33*a* may be smaller than the acute angle formed by the slope 37*b* and the guiding face 33*a*.

Figure 10:
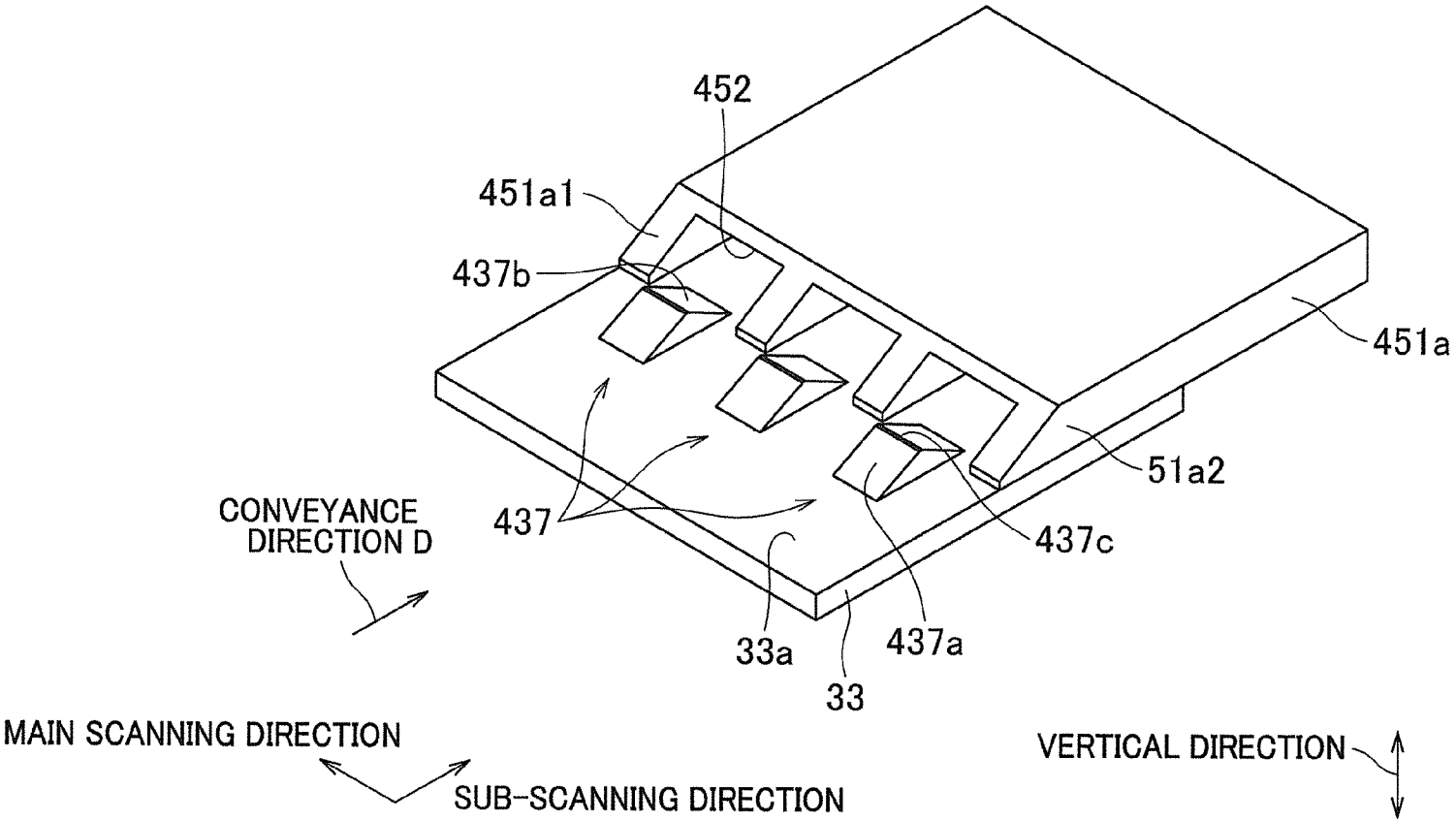
FIG. 10 is an oblique perspective view of a protrusion and an upstream supporter of an inkjet printer of Second Embodiment of the present invention.
Figure 11A:
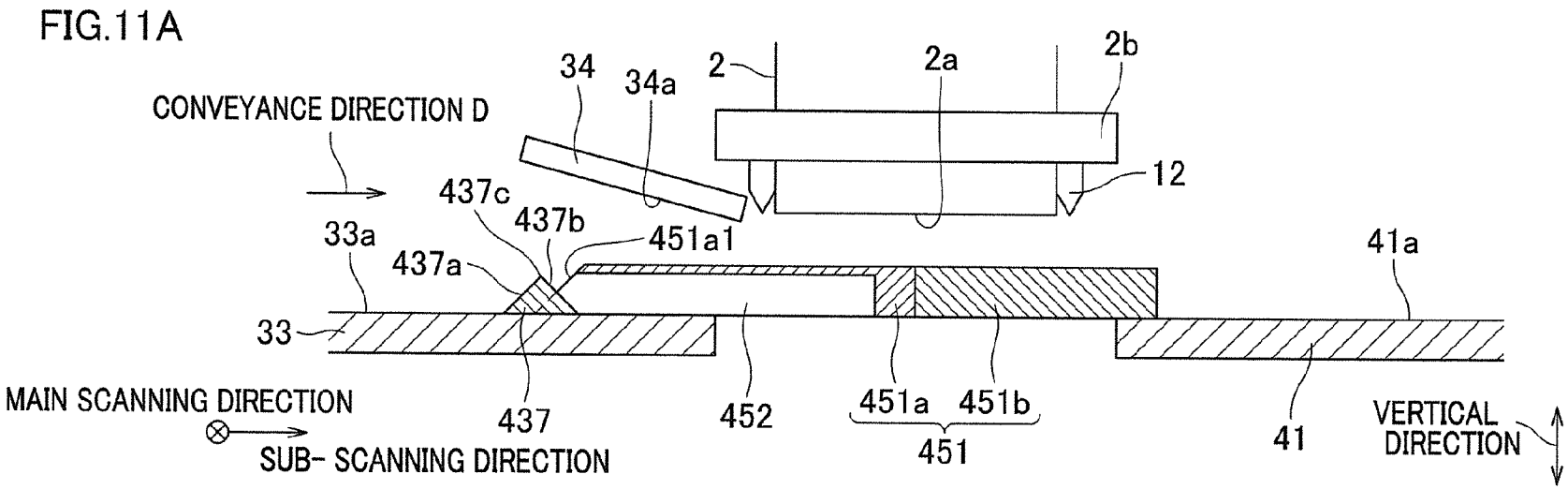
FIG. 11A is a partial profile of the printer of Second Embodiment of the present invention, when the platen is at the opposing position.

Now, referring to FIG. 10, FIG. 11A, and FIG. 11B, an inkjet printer of Second Embodiment of the present invention will be described. The printer of Second Embodiment is identical with the printer of First Embodiment, except the structures of protrusions 437 and a platen 451. The protrusion 37 of First Embodiment is configured to be housed in the recess 33*b*. In Second Embodiment, a plurality of protrusions 437 are configured to be housed in the upstream supporter 451*a*. In Second Embodiment, furthermore, the three protrusions 437 are formed on the guiding face 33*a* in an integrated manner. In other words, the upstream end of each protrusion 437 is on the same level as the guiding face 33*a*, and no gap is formed between the guiding face 33*a* and the protrusion 437 in the vertical direction. The three protrusions 437 are lined up in the main scanning direction at regular intervals. Each protrusion 437 includes two slopes 437*a* and 437*b* which are identical with the two slopes 37*a* and 37*b*.

The platen 451 includes an upstream supporter 451*a* and a downstream supporter 451*b*. The downstream supporter 451*b* is identical with the downstream supporter 51*b* except that this supporter 451*b* is thicker than the downstream supporter 51*b*. The upstream supporter 451*a* is thicker than the upstream supporter 51*a* and includes three concavities 452 on the lower surface which opposes the guiding face 33*a* when the platen 451 is at the withdrawal position. The downstream supporter 451*b* may be as thick as the downstream supporter 51*b*. The upstream supporter 451*a* may be as thick as the upstream supporter 51*a*. In such a case, the top 437*c* of the protrusion 437 must be positioned on a lower level than the top 37*c*. Each of the concavities 452 extends along the conveyance direction D and the depth thereof is longer than the protruding length of the protrusion 437. The depth of the each concavity 452 corresponds to the length between the lower surface of the upstream supporter 451*a* (i.e., the guiding face 33) and the bottom surface of the upstream supporter 451*a* defining the concavities 452. In other words, the upper surface of the upstream supporter 451*a* is positioned on an upper level than the top 437*c*. The three concavities 452 are lined up in the main scanning direction at equal intervals, and are configured to house the protrusions 437, respectively. On the upstream supporter 451*a* is formed a slope 451*a*1. This slope 451*a*1 is inclined upward in the conveyance direction D from the upstream end of the upstream supporter 451*a* toward the downstream. The slope 451*a*1 corresponds to the second slope of the present invention. As shown in FIG. 11A, when the platen 451 is at the opposing position, the upstream supporter 451*a* is positioned so that the upstream end of the upstream supporter 451*a* overlaps the protrusions 437 in the conveyance direction D. To put it differently, when the platen 451 is at the opposing position, the upstream end of the upstream supporter 451*a* is positioned between the upstream end and the downstream end of each protrusion 437 in the conveyance direction D.

Now the control regarding the recording operation will be described. When the platen 451 is at the withdrawal position before the start of the conveyance of the sheet P, the controller 100 controls the mover 53 so as to move the platen 451 from the withdrawal position to the opposing position. This control is not conducted when the platen 451 is at the opposing position before the start of the conveyance of the sheet P. Thereafter, the controller 100 controls the motors no as to drive the pickup roller 25 and the roller pairs 35, 36, and 45 to 47 in the same manner as in First Embodiment. A sheet P sent out from the sheet feeding tray 24 is conveyed to the surface of the platen 451.

The sheet P is conveyed along the guiding face 33*a*. When the leading end of the sheet P reaches the protrusions 437, the leading end is lifted from the guiding face 33*a* by the slope 437*a*, and the sheet P is guided obliquely upward along the slope 437*a*. In this state, because the upstream end of each protrusion 437 is on the same level as the guiding face 33*a*, the leading end of the sheet P is not caught by the protrusions 437. The leading end of the sheet P then gets over the top 437*c* and the sheet P is conveyed to the upper surface of the platen 451. In this state, even if the top 437*c* is positioned on a lower level than the upper surface of the upstream supporter 451*a*, the leading end of the sheet P is not caught by the upstream supporter 451*a* and is smoothly guided to the upper surface of the platen 451 along the slope 451*a*1, because, in the conveyance direction D, the upstream end of the upstream supporter 451*a* overlaps the protrusions 437 and the slope 451*a*1 overlaps the protrusions 437. This makes it possible to restrain the occurrence of the jamming of the sheet P.

When the sheet P passes through the position immediately below the head 2 in the conveyance direction D, the controller 100 controls the head 2 in the same manner as in First Embodiment so as to form a desired image on the sheet P. Thereafter, the sheet P is guided by the downstream guide unit 40 and discharged from an upper part of the housing 1*a* to the sheet discharge section 4.

Figure 11B:
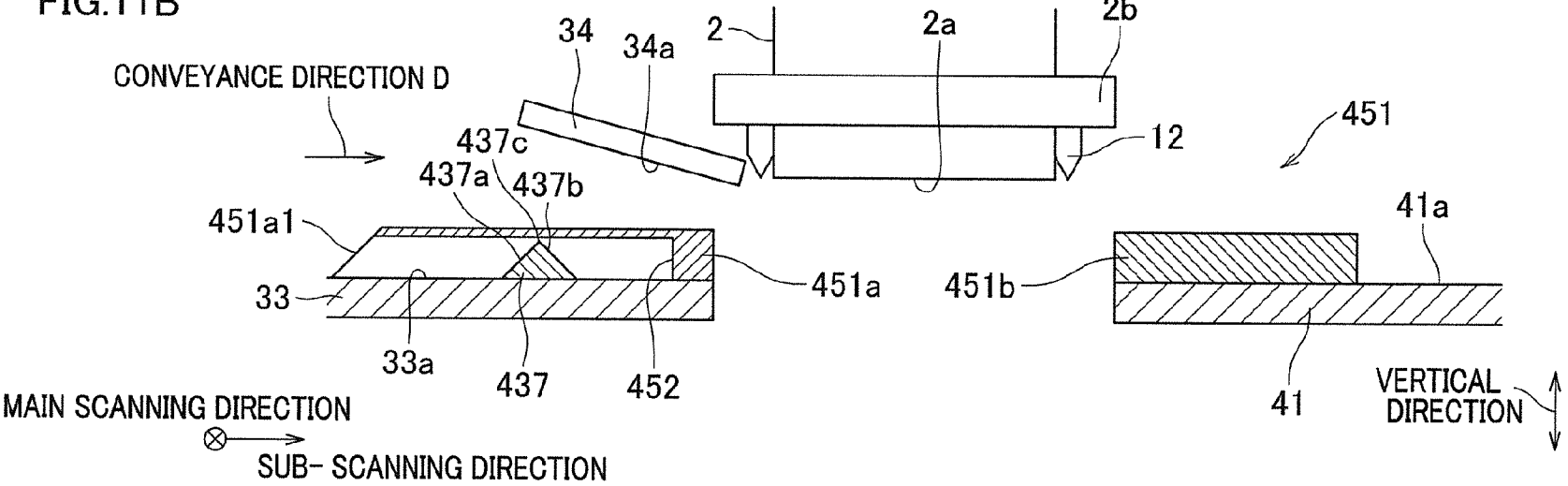
FIG. 11B is a partial profile of the printer of Second Embodiment of the present invention, when the platen is at the withdrawal position and the protrusion is housed in the upstream supporter.

When the maintenance operation is conducted, the controller 100 controls the mover 53 to move the platen 451 to the withdrawal position as shown in FIG. 11B. In so doing, each protrusion 437 is housed in the corresponding concavity 452. Thereafter, in the same manner as in First Embodiment, the controller 100 controls the opposing member elevating mechanism 11 and the pump 8 to cause the opposing member positioned at the ink receiving position to receive the ink discharged from the head 2. Thereafter, in the same manner as in First Embodiment, the controller 100 controls the wiping unit (not illustrated), the opposing member elevating mechanism 11, and the mover 53 no as to wipe the ejection surface 2*a* and the surface 10*a*. The controller 100 then controls the annular member elevation mechanism 13 to conduct the capping. As such, the maintenance operation is completed. Subsequently, upon receiving the recording command, the controller 100 controls the annular member elevation mechanism 13, the opposing member elevating mechanism 11, and the mover 53 to return the annular member 12 to the original position, move the opposing member 10 to the waiting position, and move the platen 51 to the opposing position in the same manner as in First Embodiment.

According to Second Embodiment, the protrusions 437 are housed in the concavities 452, respectively, when the platen 451 is moved to the withdrawal position. Because an arrangement to house the protrusions 437 in the guide 33 is unnecessary, the structure of the guide 33 is simplified. Furthermore, the leading end side of the conveyed sheet P contact partially with the protrusions 437. The conveyance load on the sheet P is therefore reduced in Second Embodiment as compared to First Embodiment in which the entirety of the leading end side of the sheet P contacts with the protrusion 37.

In Second Embodiment, the protrusion 437 positioned at the center in the main scanning direction among the three protrusions 437 may be positioned on the upstream as compared to the other two protrusions 437 as in the second variation. With this, the same effect as in the second variation is achieved.

When the platen 51, 451 is at the opposing position, the upstream end of the platen 51, 451 may be positioned on the downstream of the protrusion 37, 237, 337, 437. Furthermore, the protrusion 37, 237, 337, 437 may not have the slope 37*b*, 237*b*, 337*b*, 437*b*. In First Embodiment and first to third variations, the upstream supporter 51*a* may not have the slope 51*a*1, 51*a*2. Furthermore, in place of the three protrusions 437 of Second Embodiment, a single protrusion which is long in the main scanning direction in the same manner as the protrusion 37 may be provided.

The platen 51 may not contact with the protrusion 37 when it is at the opposing position, and may contact with the protrusion 37 when it is being moved from the opposing position to the withdrawal position. In this case, a regulating member is provided on the guide 33 to set the protrusion 37 at the protruding position when the platen 51 is at the opposing position. The number of the protrusions 237, 437 may be two, four, or more. Furthermore, the guide 34 may not be provided. In the embodiments and variations above, the platen 51, 451 is a double-door-type platen which opens such that parts of the platen moves in opposite directions along the conveyance direction D at the time of the movement from the opposing position to the withdrawal position. Alternatively, the platen may be a single-door-type platen that opens toward the upstream. The same effect is achieved when a single-door-type platen is employed in place of a double-door type platen. Furthermore, the annular member 12 may not be provided, i.e., only the opposing member 10 may be provided. Furthermore, the maintenance unit may not be provided.

The present invention is applicable to both line-type printers and serial-type printers. The present invention is applicable not only to printers but also any recording apparatus such as facsimile machines and photocopiers. The present invention is further applicable to recording apparatuses ejecting liquid other than ink. The present invention is not limited to inkjet recording apparatuses, and is applicable to laser-type and thermal-type recording apparatuses. The recording medium is not limited to the sheet. Various types of recordable media may be used as the recording medium.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus, comprising:

a head including an ejection surface on which a plurality of ejection openings for ejecting liquid are formed;

a conveyor configured to convey a recording medium toward a space which opposes the ejection surface;

a supporter configured to support a recording medium in the space;

a mover configured to move the supporter in a conveyance direction in which the recording medium is conveyed by the conveyor to cause the supporter to take either an opposing position at which the supporter opposes the ejection surface or a withdrawal position at which the supporter does not oppose the ejection surface; and a first guide including a guiding face which is configured to support the recording medium upstream of the supporter at the opposing position in the conveyance direction, a recess which is formed on the guiding face, and a protrusion which is configured to protrude from the guiding face through the recess, wherein:

the supporter is configured to move, by means of the mover, along the guiding face while maintaining contact with the guiding face, the protrusion includes a first slope upwardly inclined from an upstream end of the protrusion in the conveyance direction toward the downstream in the conveyance direction, the supporter includes a second slope upwardly inclined from an upstream end of the supporter in the conveyance direction toward the downstream in the conveyance direction, and when the supporter is at the opposing position:

with respect to a vertical direction in operation, the upstream end of the protrusion is positioned at a lower level than the guiding face, a top of the protrusion is positioned at a higher level than the guiding face and the upstream end of the supporter, and the protrusion protrudes from the guiding face; and with respect to the conveyance direction, the upstream end of the supporter is positioned between the upstream end and a downstream end of the protrusion, and the top of the protrusion is upstream of a downstream end of the second slope of the supporter.

2. The recording apparatus according to claim 1, wherein, the protrusion is configured to move and thereby to take either a protruding position at which the top of the protrusion protrudes from the guiding face or a housed position at which the top of the protrusion does not protrude from the guiding face, the first guide further includes an urger which is configured to urge the protrusion from the housed position toward the protruding position, the mover is configured to move the supporter toward the upstream in the conveyance direction so as to cause the supporter to move from the opposing position to the withdrawal position, and the protrusion is configured to contact the supporter so as to be moved to the housed position against an urging force of the urger, when the supporter is moved from the opposing position to the withdrawal position.

3. The recording apparatus according to claim 2, wherein, the protrusion further includes a third slope downwardly inclined from the top of the protrusion toward the downstream in the conveyance direction, and the protrusion is configured to be moved to the housed position as the supporter contacts the third slope, when the supporter is moved from the opposing position to the withdrawal position.

4. The recording apparatus according to claim 1, wherein, a surface of the supporter, which surface opposes the ejection surface when the supporter is at the opposing position, is positioned on the same level as or a lower level than the top of the protrusion when the protrusion protrudes from the guiding face.

5. The recording apparatus according to claim 1, wherein, the first guide includes two or more of the protrusions being separated from one another in a direction orthogonal to both of an orthogonal direction and the conveyance direction, the orthogonal direction being orthogonal to the ejection surface.

6. The recording apparatus according to claim 5, wherein, the protrusions are at different positions in the conveyance direction.

7. The recording apparatus according to claim 6, wherein, among the protrusions, a particular protrusion at the center in a direction orthogonal to both of the orthogonal direction and the conveyance direction is positioned upstream in the conveyance direction of the protrusions other than the particular protrusion.

8. The recording apparatus according to claim 1, further comprising:

a second guide positioned upstream of the head in the conveyance direction and including an opposing surface which opposes the protrusion, wherein:

in the second guide, an obtuse angle is formed by a first linear line extending along the first slope and a second linear line extending along a part of the opposing surface which part is downstream in the conveyance direction of an intersection between the opposing surface and the first linear line; and a downstream end of the opposing surface in the conveyance direction is positioned at a higher level than a surface of the supporter at the opposing position, which surface opposes the ejection surface, and on the same level as or a lower level than the ejection surface.

9. The recording apparatus according to claim 1, further comprising a maintenance unit which is configured to conduct a maintenance operation when the supporter is at the withdrawal position and is positioned to oppose the ejection surface over the supporter positioned at the opposing position.

10. The recording apparatus according to claim 9 wherein, the maintenance unit includes a cap which is configured to close the space.

11. The recording apparatus according to claim 9, wherein, the maintenance unit includes a receiver which is configured to receive the liquid discharged from the ejection openings.

12. A recording apparatus, comprising:

a head including an ejection surface on which a plurality of ejection openings for ejecting liquid are formed;

a conveyor configured to convey a recording medium toward a space which opposes the ejection surface;

a supporter configured to support the recording medium in the space;

a mover configured to move the supporter in a conveyance direction in which the recording medium is conveyed by the conveyor to cause the supporter to take either an opposing position at which the supporter opposes the ejection surface or a withdrawal position at which the supporter does not oppose the ejection surface; and a first guide including a guiding face which is configured to support the recording medium on the upstream of the supporter at the opposing position in the conveyance direction and a protrusion which is positioned on the upstream of the head in the conveyance direction, is integrated with the guiding face, and is configured to protrude from the guiding face, wherein, the supporter is configured to move, by means of the mover, along the guiding face while maintaining contact with the guiding face, the protrusion includes a first slope upwardly inclined from an upstream end of the protrusion in the conveyance direction toward the downstream in the conveyance direction, the supporter includes a second slope upwardly inclined from an upstream end of the supporter in the conveyance direction toward the downstream in the conveyance direction, and when the supporter is at the opposing position:

with respect to a vertical direction in operation, the upstream end of the protrusion is positioned at the same level as the guiding face, and a top of the protrusion is positioned at a higher level than the guiding face and the upstream end of the supporter; and with respect to the conveyance direction, the upstream end of the supporter is positioned between the upstream end and a downstream end of the protrusion, and the top of the protrusion is upstream of a downstream end of the second slope of the supporter.

13. The recording apparatus according to claim 12, wherein, the supporter includes a concavity on a surface which opposes the guiding face when the supporter is at the withdrawal position, the concavity extending along the conveyance direction and being configured to house the protrusion, the mover is configured to move the supporter toward the upstream in the conveyance direction so as to cause the supporter to move from the opposing position to the withdrawal position, and the protrusion is configured to be housed in the concavity when the supporter is moved from the opposing position to the withdrawal position.

* * * * *